US009103188B2

(12) United States Patent
Richard

(10) Patent No.: US 9,103,188 B2
(45) Date of Patent: Aug. 11, 2015

(54) PACKER, SEALING SYSTEM AND METHOD OF SEALING

(75) Inventor: Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 206 days.

(21) Appl. No.: 13/450,070

(22) Filed: Apr. 18, 2012

(65) Prior Publication Data

US 2013/0277068 A1 Oct. 24, 2013

(51) Int. Cl.
*E21B 33/12* (2006.01)
*E21B 33/127* (2006.01)

(52) U.S. Cl.
CPC ..... *E21B 33/1208* (2013.01); *E21B 33/127* (2013.01)

(58) Field of Classification Search
CPC ..... E21B 33/1208; E21B 33/1216; E21B 43/103; E21B 43/108
USPC ..... 166/387, 180, 118
See application file for complete search history.

(56) References Cited

U.S. PATENT DOCUMENTS

| | | | | |
|---|---|---|---|---|
| 7,234,533 | B2 * | 6/2007 | Gambier | 166/387 |
| 7,665,537 | B2 * | 2/2010 | Patel et al. | 166/387 |
| 7,841,417 | B2 * | 11/2010 | Allison et al. | 166/387 |
| 7,866,406 | B2 | 1/2011 | Mackenzie | |
| 8,048,348 | B2 * | 11/2011 | Duan et al. | 264/48 |
| 8,157,019 | B2 * | 4/2012 | King et al. | 166/387 |
| 2003/0188676 | A1 * | 10/2003 | Petrakis | 116/216 |
| 2004/0020662 | A1 * | 2/2004 | Freyer | 166/387 |
| 2004/0047573 | A1 * | 3/2004 | Lail et al. | 385/111 |
| 2004/0055760 | A1 * | 3/2004 | Nguyen | 166/387 |
| 2004/0134412 | A1 * | 7/2004 | Petrakis | 116/216 |
| 2005/0072579 | A1 * | 4/2005 | Gambier | 166/387 |
| 2007/0125532 | A1 * | 6/2007 | Murray et al. | 166/179 |
| 2007/0163777 | A1 * | 7/2007 | Murray et al. | 166/179 |
| 2007/0240877 | A1 * | 10/2007 | O'Malley et al. | 166/179 |
| 2007/0240885 | A1 * | 10/2007 | O'Mally et al. | 166/387 |
| 2008/0149323 | A1 * | 6/2008 | O'Malley et al. | 166/53 |
| 2008/0215037 | A1 * | 9/2008 | Petrakis | 604/890.1 |
| 2008/0296014 | A1 * | 12/2008 | Richard et al. | 166/187 |
| 2009/0084539 | A1 * | 4/2009 | Duan et al. | 166/187 |
| 2011/0132611 | A1 * | 6/2011 | Rytlewski et al. | 166/313 |
| 2012/0000648 | A1 * | 1/2012 | Mathew et al. | 166/135 |
| 2012/0055667 | A1 * | 3/2012 | Ingram et al. | 166/65.1 |

OTHER PUBLICATIONS

Emmanuel Pradie et al., "Corroded Casing: Testing of Sealing Capability and Retrievability of a Swellable Elastomer Packer"; Society of Petroleum Engineers; SPE Paper No. 116210; Sep. 21, 2008; 16 pages.

* cited by examiner

*Primary Examiner* — Blake Michener
(74) *Attorney, Agent, or Firm* — Cantor Colburn LLP

(57) ABSTRACT

A sealing system includes, a body, at least one swellable member in operable communication with the body configured to swell into sealing engagement with a structure proximate the body, and at least one shape memory member in operable communication with the body and configured to increase at least one dimension thereof in response to exposure to transition stimulus to cause the at least one shape memory member to contact both the body and the structure, the at least one shape memory member also configured to support the at least one swellable member against pressure urging it to move relative to at least one of the body and the structure.

19 Claims, 2 Drawing Sheets

PACKER, SEALING SYSTEM AND METHOD OF SEALING

BACKGROUND

Almost all tubular systems at some time need to employ seals against unwanted fluid flow. For example, in the carbon sequestration, hydrocarbon recovery and water well industries, when attempting to seal annular spaces cement is sometimes pumped into the annular space and left to harden. This method often works well as long as flow of the cement to all the desired locations within the annular space is not disrupted. These and other industries employing tubular systems however are always receptive to alternate systems and methods of creating seals.

BRIEF DESCRIPTION

Disclosed herein is a sealing system. The system includes, a body, at least one swellable member in operable communication with the body configured to swell into sealing engagement with a structure proximate the body, and at least one shape memory member in operable communication with the body and configured to increase at least one dimension thereof in response to exposure to transition stimulus to cause the at least one shape memory member to contact both the body and the structure, the at least one shape memory member also configured to support the at least one swellable member against pressure urging it to move relative to at least one of the body and the structure.

Further disclosed herein is a method of sealing a body to a structure. The method includes, positioning a body proximate a structure, swelling a swellable member disposed at the body into engagement with the structure, altering dimensions of a shape memory member disposed at the body into engagement with the structure, and sealing the body to the structure.

Further disclosed herein is a packer. The packer includes, a tubular positionable within a borehole, a plurality of swellable members disposed around the tubular and configured to swell into sealing engagement with the borehole, and a plurality of shape memory members disposed around the tubular in a longitudinally alternating arrangement with the plurality of swellable members configured to become compressed between the tubular and the borehole after altering dimensions thereof.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
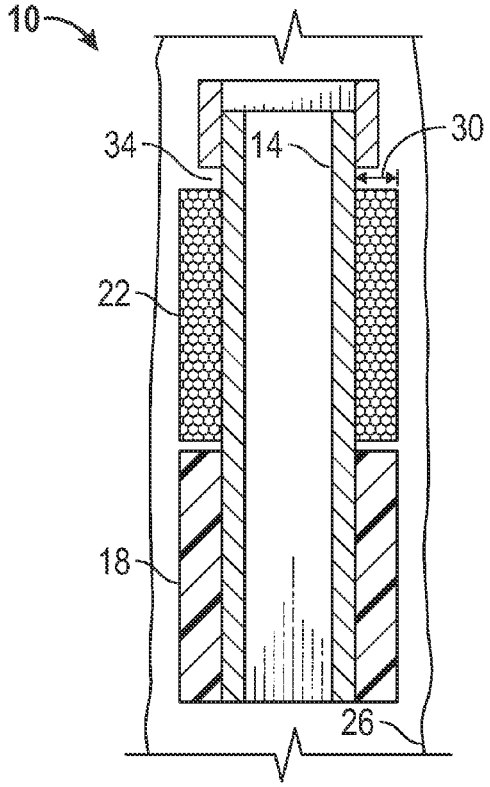
FIG. 1 depicts a cross sectional view of a sealing system disclosed herein.
Figure 2:
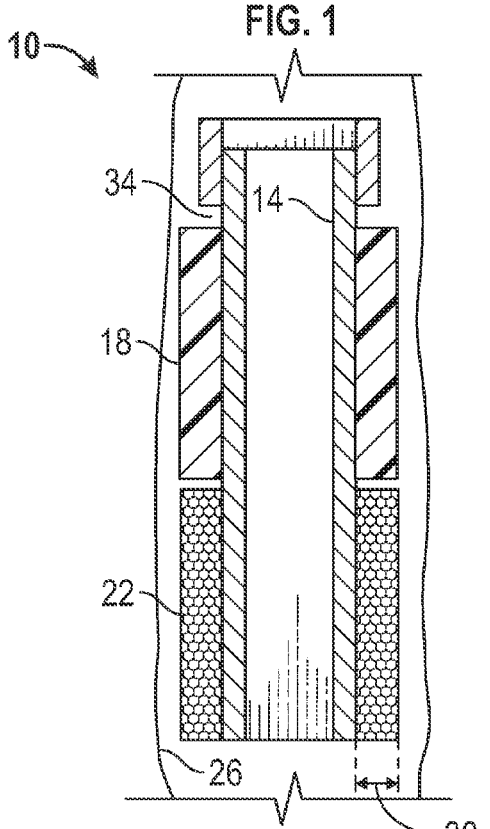
FIG. 2 depicts a cross sectional view of an alternate embodiment of a sealing system disclosed herein.

Referring to FIGS. 1 and 2, embodiments of a sealing system disclosed herein are illustrated at 10. The sealing system 10 includes, a body 14, illustrated in these embodiments as a tubular, a swellable member 18 positioned around the body 14, and a shape memory member 22 also positioned around the body 14. The body 14, the swellable member 18 and the shape memory member 22 of the sealing system 10 are deployable as a subassembly. The sealing system 10 can be positioned proximate a structure 26, such as within a borehole in an earth formation when used in the downhole industry, for example, or in a wellbore in a hydrocarbon recovery operation. The swellable member 18 is swellable upon exposure to environments that can be artificially produced, through intervention, for example, or are naturally occurring in a location wherein the system 10 is to be deployed. The swelling of the swellable member 18 being sufficient to cause sealing of the swellable member 18 to the structure 26. The shape memory member 22 is configured to alter a shape thereof upon exposure to a transition stimulus (e.g., temperature, electromagnetic radiation, electrical current, magnetic field, pH, etc.). The shape memory member 22 is configured to initially have clearance between the system 10 and the structure 26 but to come in contact with the structure 26 due to a dimension 30 thereof increasing upon exposure to the transition stimulus.

In the embodiments illustrated in the Figures the swellable member 18 and the shape memory member 22 are both positioned in an annular space 34 defined between the body 14 and the structure 26. The swellable member 18 sealably engages with the structure 26 upon swelling thereof. Although the swellable member 18 may be constructed of various materials, polymeric materials have been shown to swell a substantial amount and have the ability to conform to irregular surfaces such as may exist on the structure 26 if the structure 26 is a borehole in an earth formation, for example. Such conformability is advantageous for sealing. The large amount of swelling that may occur however also results in a weakening of the material such that it may be susceptible to extrusion and damage due to forces acting thereon such as in response to a pressure differential across the swellable member 18. Positioning the shape memory member 22 proximate the swellable member 18 allows the shape memory member 22 to serve as a dam to support the swellable member 18 against extrusion. By having the shape memory member 22 span the same dimension (the radial extent of the annular space 34 in these embodiments) as the swellable member 18, there is no gap left between the shape memory member 22 and the structure 26 through which the swellable member 18 is able to extrude. Additionally, compression of the shape memory member 22 between the body 14 and the structure 26 provides stored energy engagement therewith thereby increasing extrusion forces supportable by the shape memory member 22.

Several materials have been found that exhibit shape memory characteristics, and as such could be employed in the shape memory member 22. Polymeric foam is one such material. Polymeric foam has been found to be able to significantly alter dimensions thereof in response to exposure to specific transition stimulus, and as such is a good candidate for usage in the shape memory member 22. Some such foam, however, have an open cell structure that can permit permeation of fluids therethrough. The combination of the swellable member 18 and the shape memory member 22 of the system 10 disclosed herein together provide benefits that neither can provide alone. The swellable member 18 provides an effective seal to prevent flow of fluid thereby while the shape memory member 22 provides structural support to the swellable member 18 to prevent extrusion and damage thereto that if allowed to occur could allow fluid leakage thereby.

Figure 3:
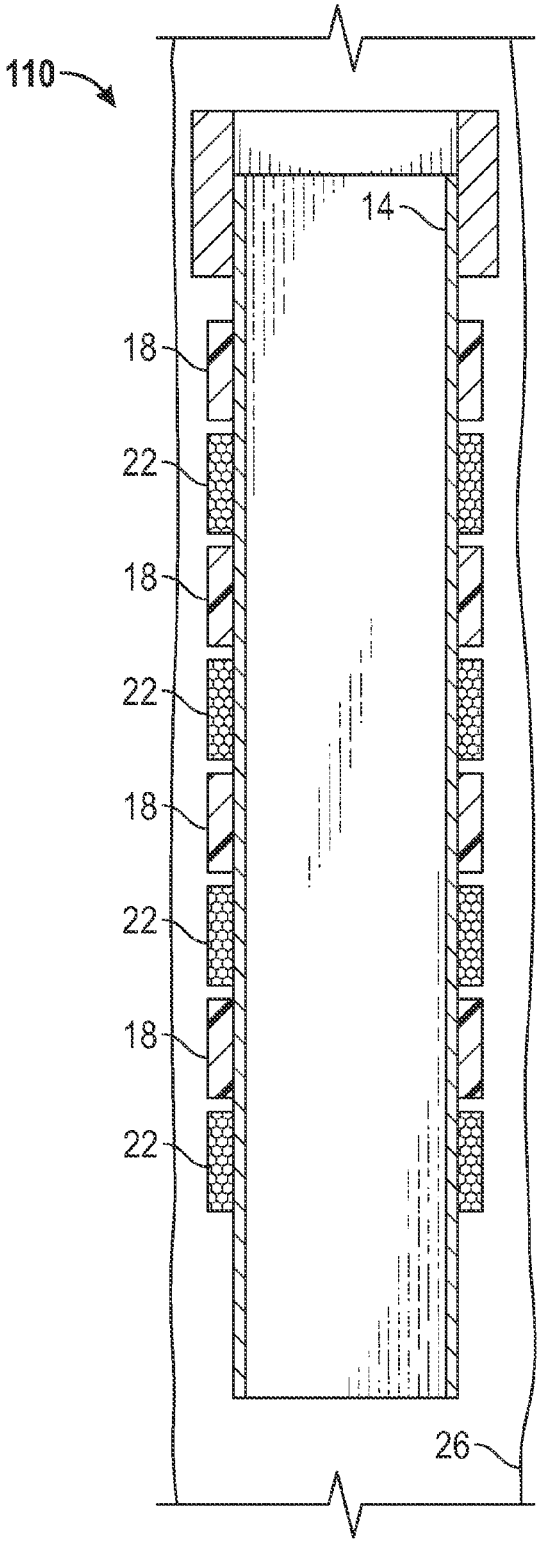
FIG. 3 depicts a cross sectional view of another alternate embodiment of a sealing system disclosed herein.

Referring to FIG. 3, an alternate embodiment of a sealing system disclosed herein is illustrated at 110. The system 110 differs from the system 10 in the number of swellable members 18 and the number of shape memory members 22 employed. Although the illustration shows four of the swellable members 18 and four of the shape memory members 22 used in the system 110 it should be understood that any practical number and alternating variations of the swellable members 18 and the shape memory members 22 could be used. There are a few advantages of employing a plurality of the members 18 and 22. One advantage is that of redundancy. That is, if one of the members 18, 22 were to fail the others can maintain full sealing and supporting functionality of the system 110. Another benefit is an increase in differential pressure that can be maintained over the sealing system 110 over the sealing system 10. Additionally, since some of the swellable members 18 have one of the shape memory members 22 located on both longitudinal sides thereof, bidirectional support is provided to those particular swellable members 18.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A sealing system comprising:

a body;

at least one swellable member in operable communication with the body configured to swell into sealing engagement with a downhole structure proximate the body while downhole; and at least one shape memory member separate from the downhole structure and in operable communication with the body being configured to increase at least one dimension thereof in response to exposure to transition stimulus to cause the at least one shape memory member to directly contact both the body and the downhole structure while downhole, the at least one shape memory member being configured to return toward a shape the at least one shape memory member previously had, the at least one swellable member being configured to swell toward a shape the at least one swellable member did not previously have, the at least one shape memory member being positioned adjacent to the least one swellable member without longitudinally overlapping with the at least one swellable member when the sealing system is configured to be run into the downhole structure, the downhole structure being positioned downhole prior to the sealing system being run into the downhole structure, the shape memory member also being configured to support the at least one swellable member against pressure urging it to move relative to at least one of the body and the structure.

2. The sealing system of claim 1, wherein the body is tubular.

3. The sealing system of claim 1, wherein the at least one swellable member and the at least one shape memory member are positioned within an annular space between the body and the downhole structure.

4. The sealing system of claim 1, wherein the downhole structure is a borehole.

5. The sealing system of claim 1, wherein the at least one swellable member is polymeric.

6. The sealing system of claim 1, wherein the at least one shape memory member is foam.

7. The sealing system of claim 1, wherein the at least one shape memory member is polymeric.

8. The sealing system of claim 1, wherein the at least one swellable member is at least two swellable members and the at least one shape memory member is positioned longitudinally between the at least two swellable members.

9. The sealing system of claim 1, wherein the at least one shape memory member is at least two shape memory members and the at least one swellable member is positioned longitudinally between the at least two shape memory members.

10. The sealing system of claim 1, wherein the transition stimulus is an environment anticipated to exist downhole or via intervention.

11. The sealing system of claim 1, wherein the at least one swellable member is configured to swell in response to exposure to an environment anticipated to exist downhole or via intervention.

12. The sealing system of claim 1, wherein the at least one shape memory member has greater structural integrity when in contact with both the body and the downhole structure than the at least one swellable member.

13. The sealing system of claim 1, wherein at least one shape memory member is configured to provide structural support against extrusion under a pressure differential thereacross when in contact with both the body and the downhole structure not available from the at least one swellable member and the at least one swellable member is configured to provide sealing to the downhole structure when swelled into contact with the downhole structure that is not available from the at least one shape memory member.

14. A method of sealing a body to a downhole structure, comprising:

positioning a body, a swellable member, and a shape memory member downhole proximate a downhole structure, the downhole structure being separate from the shape memory member and the downhole structure being downhole prior to positioning the body, the swellable member, and the shape memory member proximate the downhole structure;

swelling the swellable member disposed at the body toward a shape the swellable member did not previously have and into engagement with the downhole structure;

altering dimensions of the shape memory member disposed at the body adjacent to the swellable member and not longitudinally overlapping with the swellable member toward a shape the shape memory member previously had and into direct contact with both the body and the downhole structure; and sealing the body to the downhole structure.

15. The method of sealing the body to the downhole structure of claim 14, wherein the positioning the body, the swellable member, and the shape memory member includes running the body, the swellable member, and the shape memory member into a downhole borehole.

16. The method of sealing the body to the downhole structure of claim 14, wherein the swelling of the swellable member is in response to exposing the swellable member to downhole conditions or via intervention.

17. The method of sealing the body to the downhole structure of claim 14, wherein the altering dimensions of a shape memory member is in response to exposure of the shape memory member to downhole conditions or via intervention.

18. The method of sealing the body to the downhole structure of claim 14, further comprising supporting the swellable member against extrusion with the shape memory member.

19. A packer comprising:

a tubular positionable within a borehole within an earth formation;

a plurality of swellable members disposed around the tubular being configured to swell toward a shape the plurality of swellable member did not previously have and into sealing engagement with walls of the borehole and a plurality of shape memory members disposed around the tubular in a longitudinally alternating arrangement with the plurality of swellable members and not longitudinally overlapping with the plurality of swellable members, the plurality of shape memory members being configured to alter dimensions thereof toward a shape the plurality of shape memory members previously had and become compressively in direct contact with both the tubular and the walls of the borehole after altering dimensions thereof.

* * * * *